US008004378B2

(12) United States Patent
Wanner

(10) Patent No.: US 8,004,378 B2
(45) Date of Patent: Aug. 23, 2011

(54) COIL CONFIGURATION HAVING A COIL BRACE OF AN ELECTROMAGNETIC DRIVE

(75) Inventor: Hartmut Wanner, Herrenberg-Oberjesingen (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 12/514,032

(22) PCT Filed: Jul. 19, 2007

(86) PCT No.: PCT/EP2007/057487
§ 371 (c)(1),
(2), (4) Date: Jan. 7, 2010

(87) PCT Pub. No.: WO2008/009731
PCT Pub. Date: Jan. 24, 2008

(65) Prior Publication Data
US 2010/0127808 A1 May 27, 2010

(51) Int. Cl.
*H01F 5/00* (2006.01)

(52) U.S. Cl. ..... 335/282; 335/299; 335/266; 335/268

(58) Field of Classification Search ..... 335/132, 335/266, 268, 282, 299
See application file for complete search history.

(56) References Cited

U.S. PATENT DOCUMENTS

| | | | |
|---|---|---|---|
| 3,363,210 | A | 1/1968 | Hollyday |
| 4,122,425 | A | 10/1978 | Hughes |
| 4,720,126 | A | 1/1988 | Mike |
| 5,058,821 | A | 10/1991 | Yamashita |

FOREIGN PATENT DOCUMENTS

| | | |
|---|---|---|
| DE | 1 464 817 | 12/1968 |
| DE | 1 564 080 | 10/1970 |
| DE | 7 105 454 | 10/1971 |
| DE | 27 54 124 | 6/1979 |
| DE | 40 41 879 | 7/1991 |
| DE | 10 2004 032373 | 1/2006 |
| EP | 1 614 518 | 1/2006 |
| GB | 2 382 227 | 5/2003 |
| WO | WO 02/18780 | 3/2002 |

OTHER PUBLICATIONS

International Search Report for PCT/EP2007/057487, date Oct. 1, 2007.

*Primary Examiner* — Ramon M Barrera
(74) *Attorney, Agent, or Firm* — Kenyon & Kenyon LLP

(57) ABSTRACT

A coil configuration having a tube-shaped coil brace of an electromagnetic drive is provided, particularly a two-stage starter solenoid switch, the coil configuration having a holding winding and a pull-in winding. The coil brace has at its one end a first delimitation and at its other end a second delimitation, between which the holding winding is situated. The first delimitation has on its side, facing away from its second delimitation, an axial recess for accommodating the pull-in winding.

12 Claims, 15 Drawing Sheets

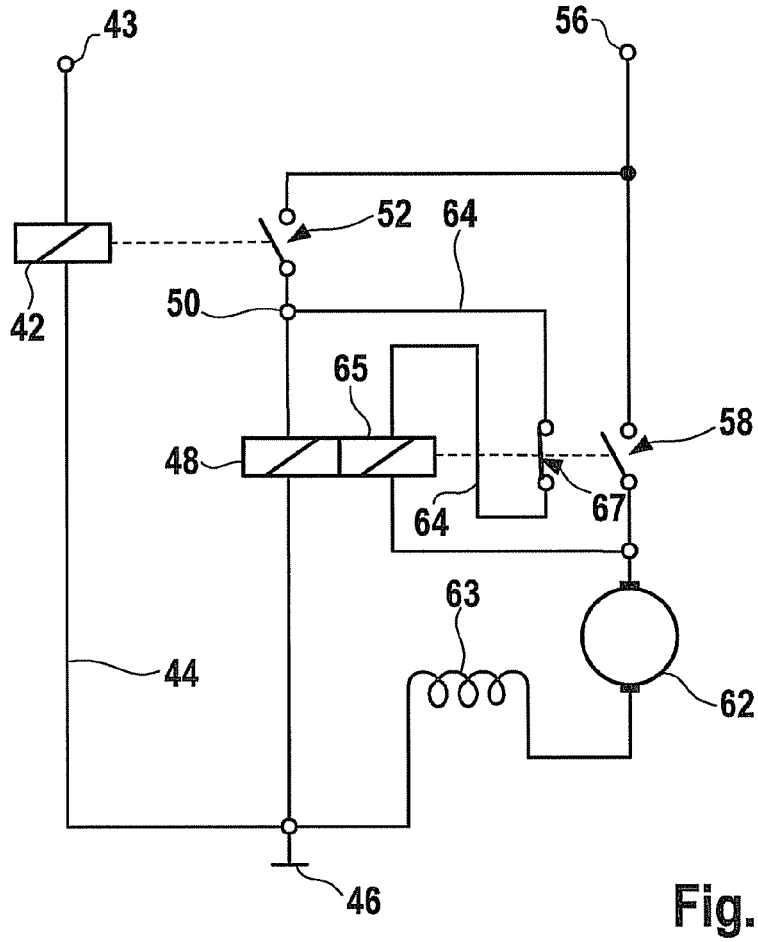
Fig. 13
Fig. 14
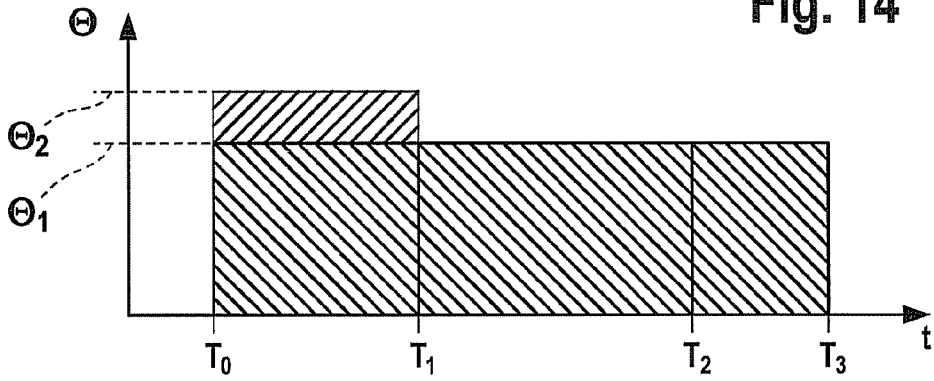

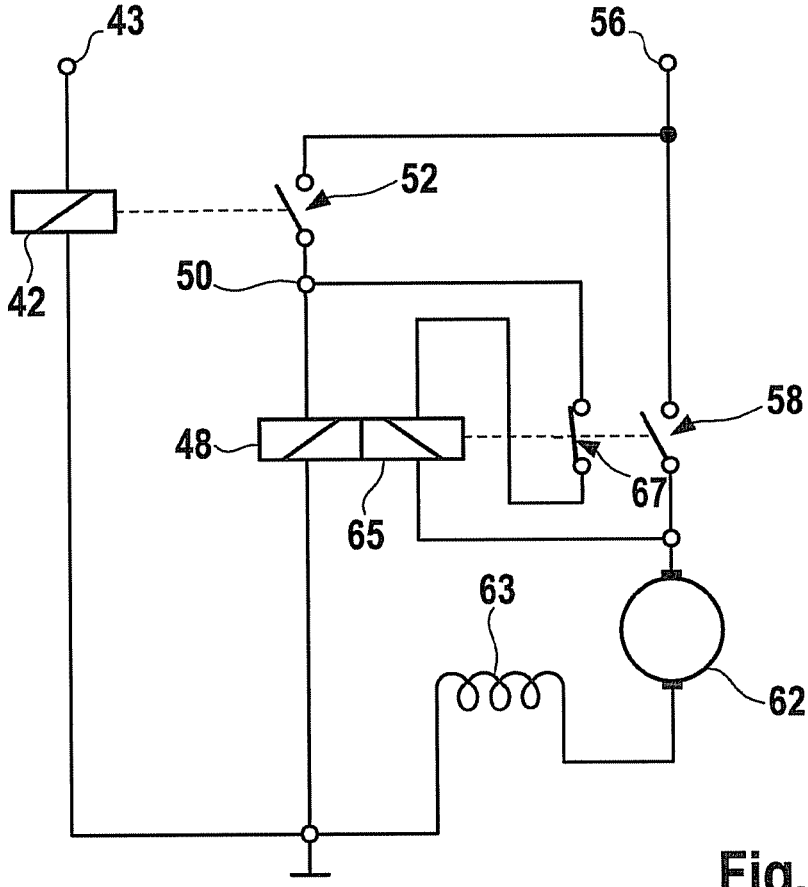
Fig. 15
Fig. 16
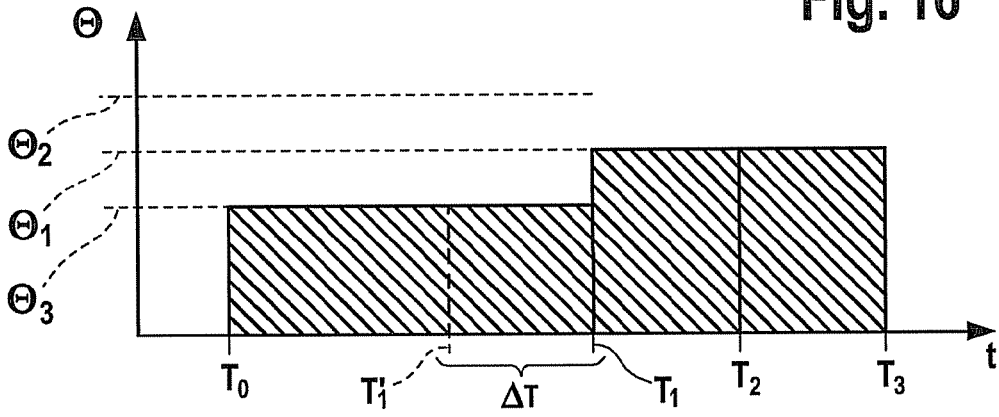

COIL CONFIGURATION HAVING A COIL BRACE OF AN ELECTROMAGNETIC DRIVE

BACKGROUND OF THE INVENTION

1. Field of the Invention

The present invention relates to a coil configuration having a tube-shaped coil brace of an electromagnetic drive, particularly a two-stage starter solenoid switch, the coil configuration having a holding winding and a pull-in winding, and the coil brace having at its one end a first delimitation and at its other end a second delimitation, between which the holding winding is situated.

2. Description of Related Art

Coil configurations of the kind described above are known. For instance, there are coil configurations of this type of two-stage starter solenoid switch of internal combustion engine starters which pose high performance and great demands on the service life. The starter solenoid switch is used to push the driving pinion of the starter into a toothed wheel of a transmission or of the internal combustion engine. In the case of single-stage starter solenoid switches, which only effect an axial shifting of the pinion, a large proportion of tooth-against-tooth positions occur, which are resolved using the large spring force of a meshing spring and using a high drive torque of the starter, whereby a high mechanical wear is created on the pinion and the toothed wheel. This is why two-stage starter solenoid switches are preferably used. They not only act to shift the pinion axially, but also act to rotate the pinion, while it is being pushed in, by a relatively small torsional current, so that the probability that teeth of the pinion mesh with the gaps of the toothed wheel of the transmission is increased.

In one known specific embodiment, a control relay switches a switching device so that the pull-in winding and the holding winding of the starter solenoid switch have current applied to them, the pull-in winding via its very low-resistance making available a torsional current to the starter motor at the same time. A relatively low current thus ensures the rotation of the pinion during meshing. During the alignment process a switch is also operated by which the starter motor is directly connected to the voltage source, so that it turns on with full torque and thereby connects the pull-in winding nearly without current. When separating the starter motor from the voltage source, since a resupply of current takes place via the pull-in winding to the holding winding, the number of turns of the holding winding has to be close to equal to the number of turns of the pull-in winding, so that the magnetic fields of the two windings mutually almost cancel out. Otherwise it is not possible to switch off the starter.

Because of a low-resistance design of the pull-in winding for providing the torsional current, and because of the specification of the equality of turns of the pull-in winding and the holding winding, the design possibilities with respect to dynamic response and a maximum admissible on-period are greatly limited. In this context, only holding windings having very high current densities are able to be used, whereby only a very brief on-period can be implemented.

Published German patent document DE 2004 032373 describes a two-stage starter solenoid switch, to which a switching device of the pull-in winding is assigned, so that a resupply of current via the pull-in winding to the holding winding is able to be interrupted. Now, since the approximate turns equality is no longer required, the designs of the windings are able to be optimized for their respective purposes. Published German patent document DE 10 2004 032373 provides a tube-shaped coil brace, in this instance, which has a first delimitation at one end and a second delimitation at the other end, a holding winding being wound up between the two delimitations, and between one of the delimitations and a pull-in winding delimitation, which is situated between the two other delimitations, a pull-in winding is wound up, so that a clear position is defined for the pull-in winding, and it does not change its position any more with the winding, or rather winding up of the holding winding.

BRIEF SUMMARY OF THE INVENTION

According to the present invention, the first delimitation of the tube-shaped coil brace of the coil configuration has on its side, facing away from the second delimitation, an axial recess for accommodating the pull-in winding. The delimitations thus executed, which advantageously are developed to be of one piece with the tube-shaped coil brace, enable a simple and cost-effective construction of the coil configuration, in which the pull-in winding and the holding winding are situated in two different chambers on the coil brace. The pull-in winding, in this context, is not wound up or wound on the coil brace, as in the related art. Instead, the pull-in winding is formed in a prior step, and is subsequently pushed into the axial recess of the first delimitation. That is, the pull-in winding is mounted on the coil brace independently of the holding winding, whereby advantages come about in manufacturing and assembly.

The number of layers of the windings of the pull-in winding is advantageously even, so that the ends of the wires only point to one side of the pull-in winding. The pull-in winding is thereby contacted electrically in a simple manner. The number of layers is also preferably a multiple of two.

According to one refinement of the present invention, the pull-in winding has two windings. Because of the nominal voltage of 12 Volt for the drive, there comes about, among other things, an approximately twice as large torsional current through the pull-in winding as a design condition, as compared to a drive having a nominal voltage of 24 Volt. A wire with which the pull-in winding is constructed has to be increased accordingly in size, in cross section. The number of turns of the pull-in winding also has to be reduced, so that a very small number of windings is used, a number of two windings turning out to be the optimum in this case.

Because of the optimum number of turns of the pull-in winding, there comes about, for the design of the layers of windings, a requirement for two windings and two layers, which, according to one refinement of the present invention, is fulfilled in that the windings, or the wires of the windings are situated not (axially) side-by-side but (radially) one over another, so that the windings of the pull-in winding lie in a common plane. Because of this space-saving arrangement, sufficient space is yielded, at the same time, for the windings of the holding winding.

At the one end of the coil brace, at which the first delimitation is situated, an access panel is expediently provided for fixing the pull-in winding in the axial recess. For this purpose, the axial recess advantageously has at least one shoulder that is used as a support surface for the access panel, so that the access panel is positioned on, and/or in the recess and/or is able to be fastened there. The access panel expediently has an opening, through which a movable core is able to be guided which, if the coil configuration is used in a two-stage starter solenoid switch of a starter of an internal combustion engine, pushes a drive pinion onto a toothed wheel that is operationally connected to the internal combustion engine. The access panel is advantageously developed to be annular, so that it is inserted completely into the axial recess. In this context, the access panel and/or the first delimitation naturally have openings or passages, through which the ends of the wires of the pull-in winding may be guided.

According to one further improvement of the present invention, a radial recess is formed in the first delimitation.

At least one part of the holding winding is advantageously situated in the radial recess. In the preparation of the holding winding, which is situated between the first and the second delimitation, the first windings are preferably wound in the radial recess, the diameter of the bottom surface of the circumferentially developed radial recess being greater than the diameter of the tube-shaped coil brace, so that the wire of the holding winding is preferably guided via a ramp channel to the smaller diameter of the coil brace.

According to one refinement of the present invention, the radial recesses and/or the axial recesses are developed in such a way that the pull-in winding and the holding winding are adjacent axially, or axially and radially. Because the holding winding is developed to be axially and radially adjacent to the pull-in winding, it is possible to prepare a large number of holding winding turns, without having to increase the overall length of the coil brace in the process.

The pull-in winding is advantageously developed so that it acts codirectionally with the holding winding. The magnetic fields of the holding winding and the pull-in winding thereby supplement each other.

In one additional specific embodiment of the present invention, the pull-in winding is developed in such a way that it acts in the opposite direction to the holding winding. For this reason, the entire magnetic field is weakened during the meshing process, whereby it takes longer, at a constant torsional current. As a result, the torsional angle of the drive pinion during the meshing process is about twice as big, whereby the component stress of pinion and toothed wheel is reduced, since the probability that a tooth tip, of a tooth of the pinion, hits a tooth tip, of a tooth of the toothed wheel, is greatly reduced.

Furthermore, a device for shifting a drive element is provided, using an electromagnetic drive having a coil configuration as described above, wherein, by shifting the movable core, that is excitable by the coil configuration, a first switch is to be opened and, because of that, first a current flow through the pull-in winding is to be interrupted, and subsequently, a second switch is able to be closed; the second switch making possible a current supply of a main drive, which is provided for the drive of the drive element. The first switch is advantageously a mechanical or an electronic switch.

BRIEF DESCRIPTION OF SEVERAL VIEWS OF THE DRAWING

FIG. 13 shows a block diagram of the circuit in a second example embodiment.

FIG. 14 shows a diagram to illustrate the curve over time of the electromagnetic magnetomotive force, according to the second exemplary embodiment.

FIG. 15 shows a block diagram of the circuit according to a third exemplary embodiment.

FIG. 16 shows a diagram to illustrate the curve over time of the electromagnetic magnetomotive force, according to the third exemplary embodiment.

DETAILED DESCRIPTION OF THE INVENTION

Figure 1:
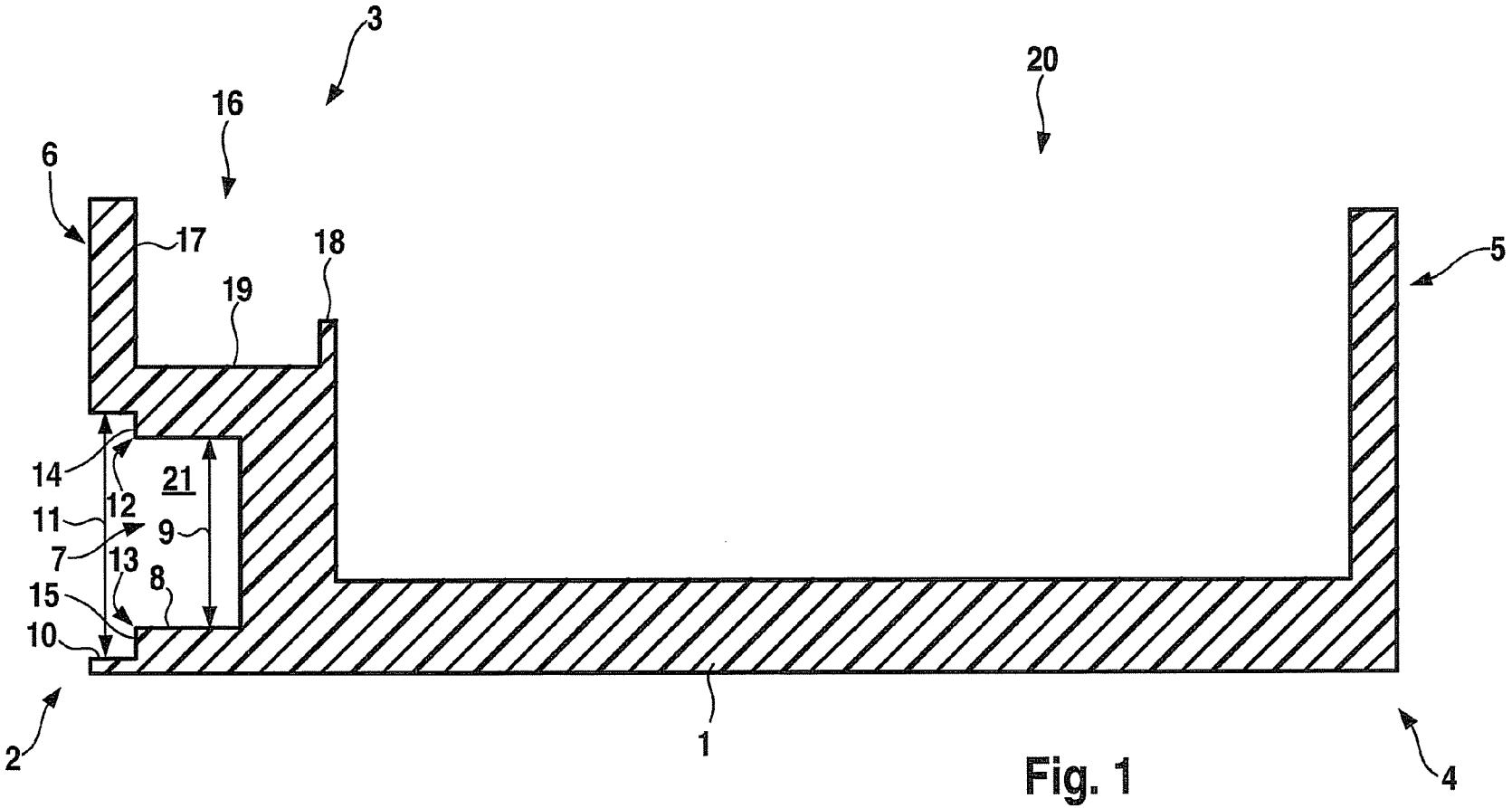
FIG. 1 shows an example embodiment of a coil brace according to the present invention.

FIG. 1 shows a sectional representation of an exemplary embodiment of a cylindrical coil brace 1 according to the present invention, of which only the upper part is shown. At its left end 2, coil brace 1 has a first delimitation 3, and at its right end 4 it has a second delimitation 5, delimitations 3, 5 being developed in one piece with coil brace 1. At its side 6 facing away from delimitation 5, delimitation 3 has an axial recess 7 that has a first region 8 having a height 9, and a second region 10 having a height 11, height 11 of outer region 10 being greater than height 9 of inner region 8. Because of the different heights 9, 11, two shoulders 12 and 13 are formed in recess 7, which each have a contact surface 14, 15.

In addition, delimitation 3 has a radial recess 16, radial recess 16 being partially situated above axial recess 7. Crosspieces 17, 18, that border on radial recess 16, are developed differently, right crosspiece 18 having a lesser height from bottom surface 19 of radial recess 16 than cross piece 17.

A chamber 20 for a holding winding is formed by coil brace 1 and delimitations 3 and 5, and a chamber 21 for a pull-in winding is formed by recess 7.

Figure 2:
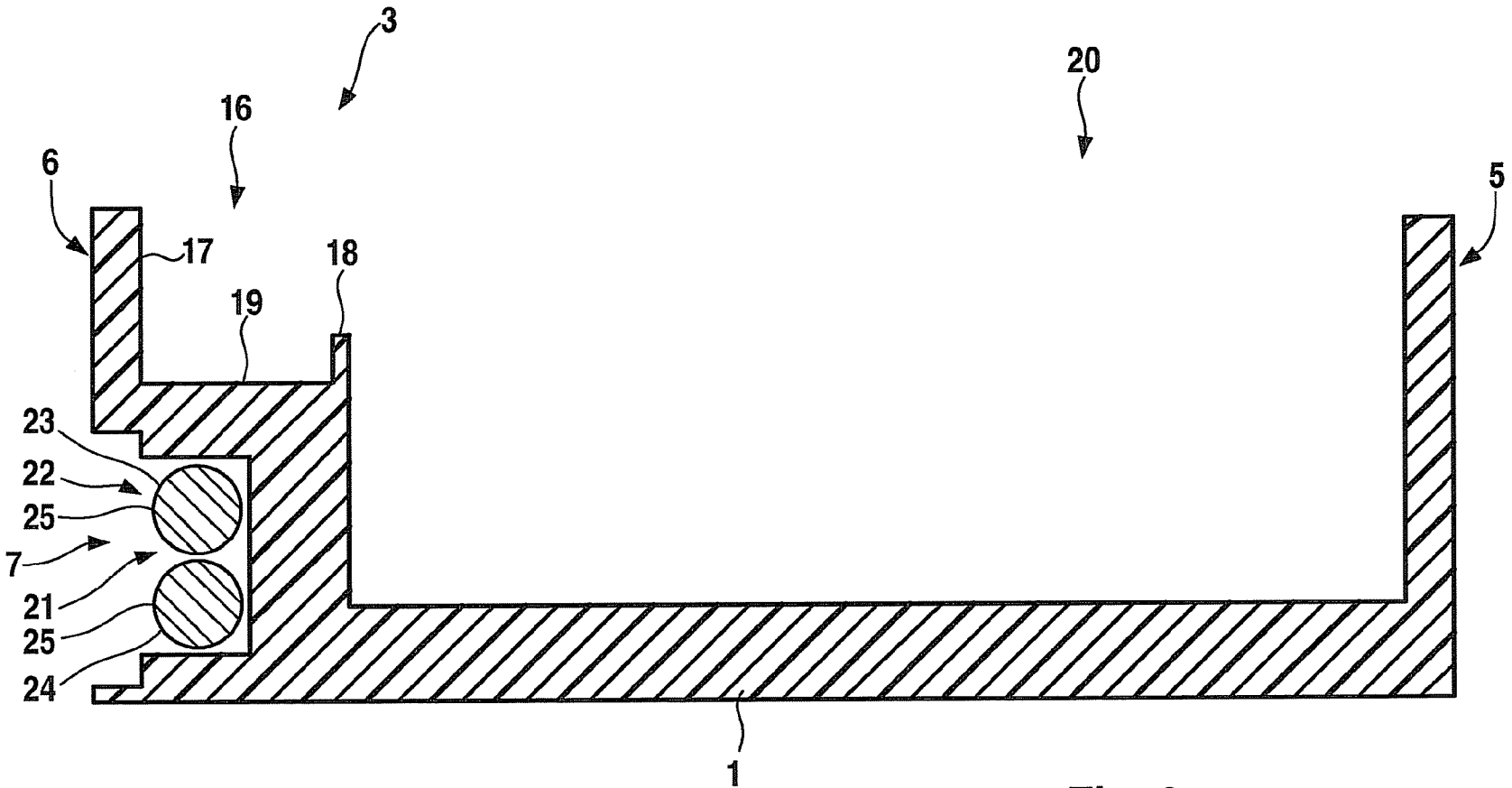
FIG. 2 shows a configuration according to the present invention of a pull-in winding on the coil brace.

FIG. 2, also in a sectional representation, shows coil brace 1 of FIG. 1, the same elements being provided with the same reference numerals. A pull-in winding 22 is situated in recess 7, which is composed of two windings 23, 24, which are positioned in two layers, one above the other. During assembly, pull-in winding 22 is pushed axially into axial recess 7 and not, as would be customary in the related are, wound or spooled about a region of coil brace 1. Because of the separate positioning of pull-in winding 22 in chamber 21, a costly insulation between pull-in winding 22 and holding winding becomes unnecessary. Furthermore, the holding winding and pull-in winding 22 may be mounted on coil brace 1 independently of each other, whereby advantages in the production process come about. Advantages also come about in the maintenance of the drive, to which the coil configuration made up of coil brace 1 and holding winding (not shown here) belong. The insulation of pull-in winding 22 is achieved, for example, by a lacquer insulation or by bandaging of the wire used and/or by air gap insulation. Because of the large torsional current that is used to rotate a drive pinion of the drive unit, wire 25 of turns 23, 24 has a correspondingly large cross section and only two turns. Since it is also required that the number of layers be an even number, so that pull-in winding 22 will lead wire ends advantageously in and out only on one side, turns 23 and 24 are positioned one over the other in one plane. This arrangement at the same time enables as large as possible a winding space, or rather as large as possible a winding chamber 20 for the holding winding.

Figure 3A:
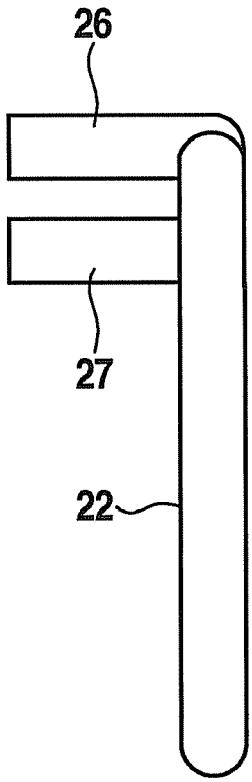
FIGS. 3*a* and *b* show an example embodiment according to the present invention of the pull-in winding.
Figure 3B:
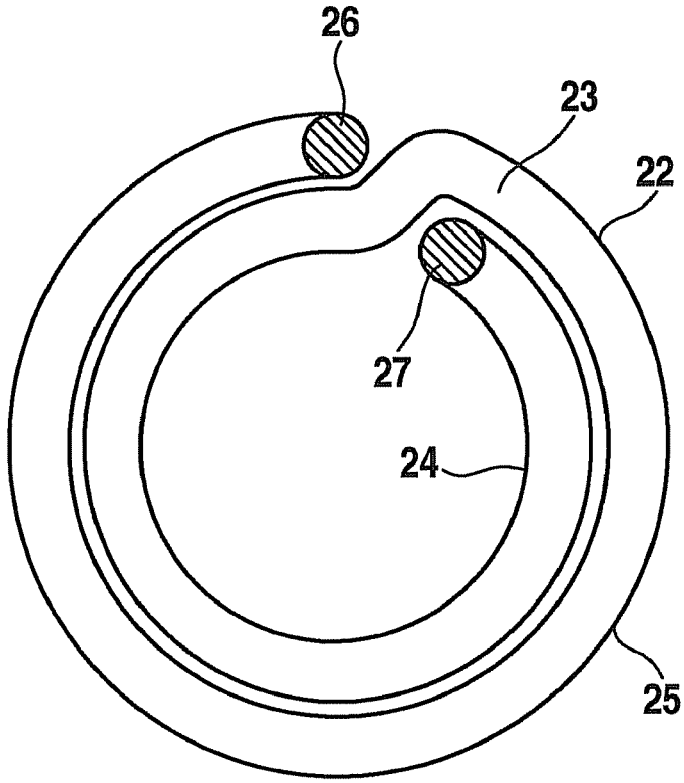

FIG. 3*a* shows an exemplary embodiment of pull-in winding 22 in a side view, wire ends 26 and 27 of the two layers of turns standing away perpendicularly from the plane of the turns. In FIG. 3*b* the same pull-in winding 22 is shown in a top view, the two turns 23, 24 being situated in two layers, one over the other. Depending on the resistance material used, and depending on the size of the cross sectional plane of (lacquer-insulated) wire 25, different values come about at a constant voltage, the torsional current increasing with increasing cross section.

Thus, first of all, pull-in winding 22 is put in the desired shape, and only then is placed into axial recess 7.

Figure 4:
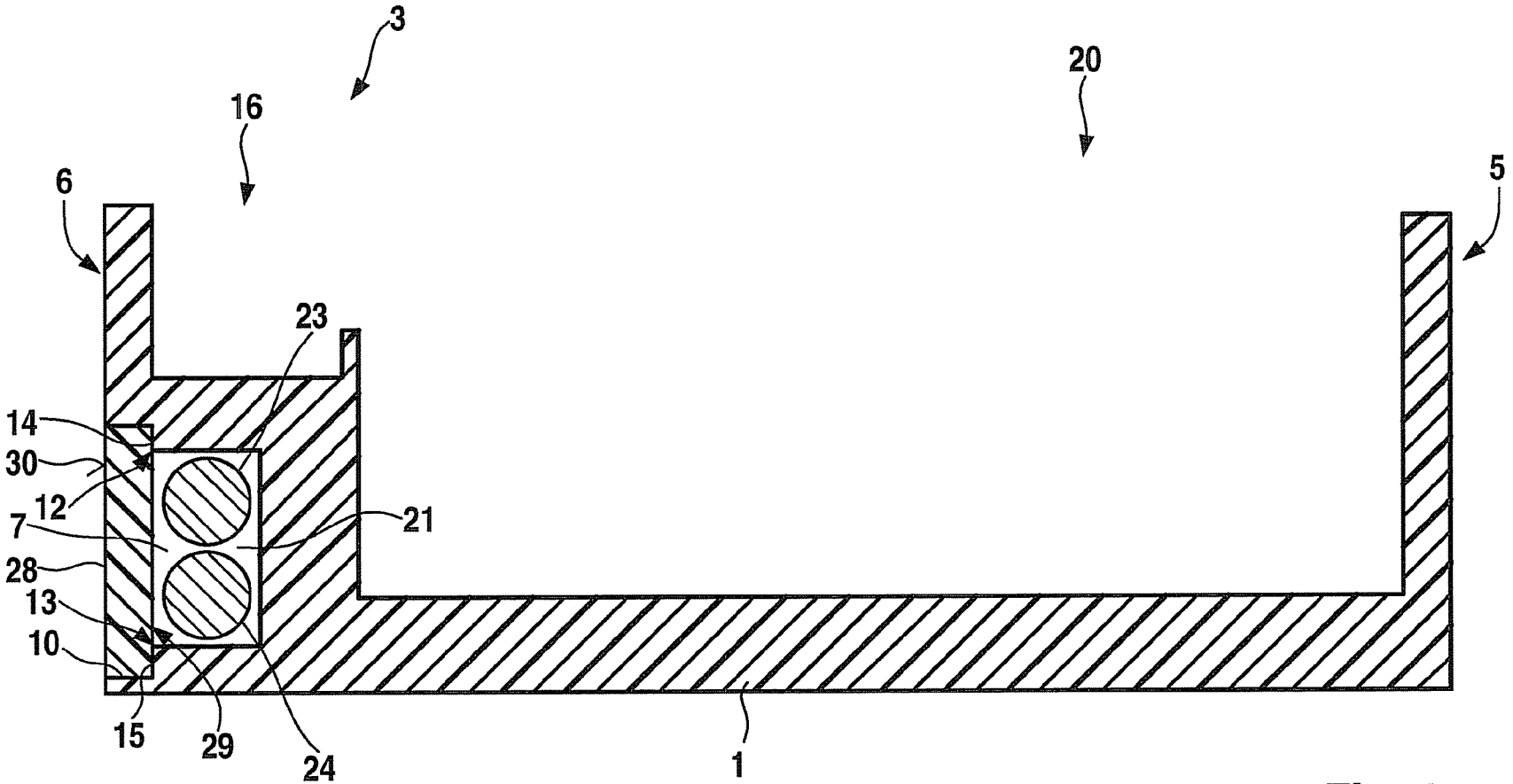
FIG. 4 shows the coil brace having an access panel according to the present invention.

FIG. 4 shows a coil brace 1 as in FIGS. 1 and 2, and also in sectional representation, in which only the upper part of the coil brace is shown. In recess 7 in region 10 an access panel 28 is situated which, with its surface 29 pointing inwards, lies against contact surfaces 14 and 15 of shoulders 12 and 13. Access panel 28 is designed so that its outwards pointing surface 30 closes flush with side 6 of delimitation 3. Access panel 28 is used for fixing pull-in winding 22 with its turns 23 and 24 in axial recess 7, or chamber 21. Naturally, access panel 28 has openings for wire ends 26, 27 (not shown here), so that these are able to be contacted electrically.

Figure 5:
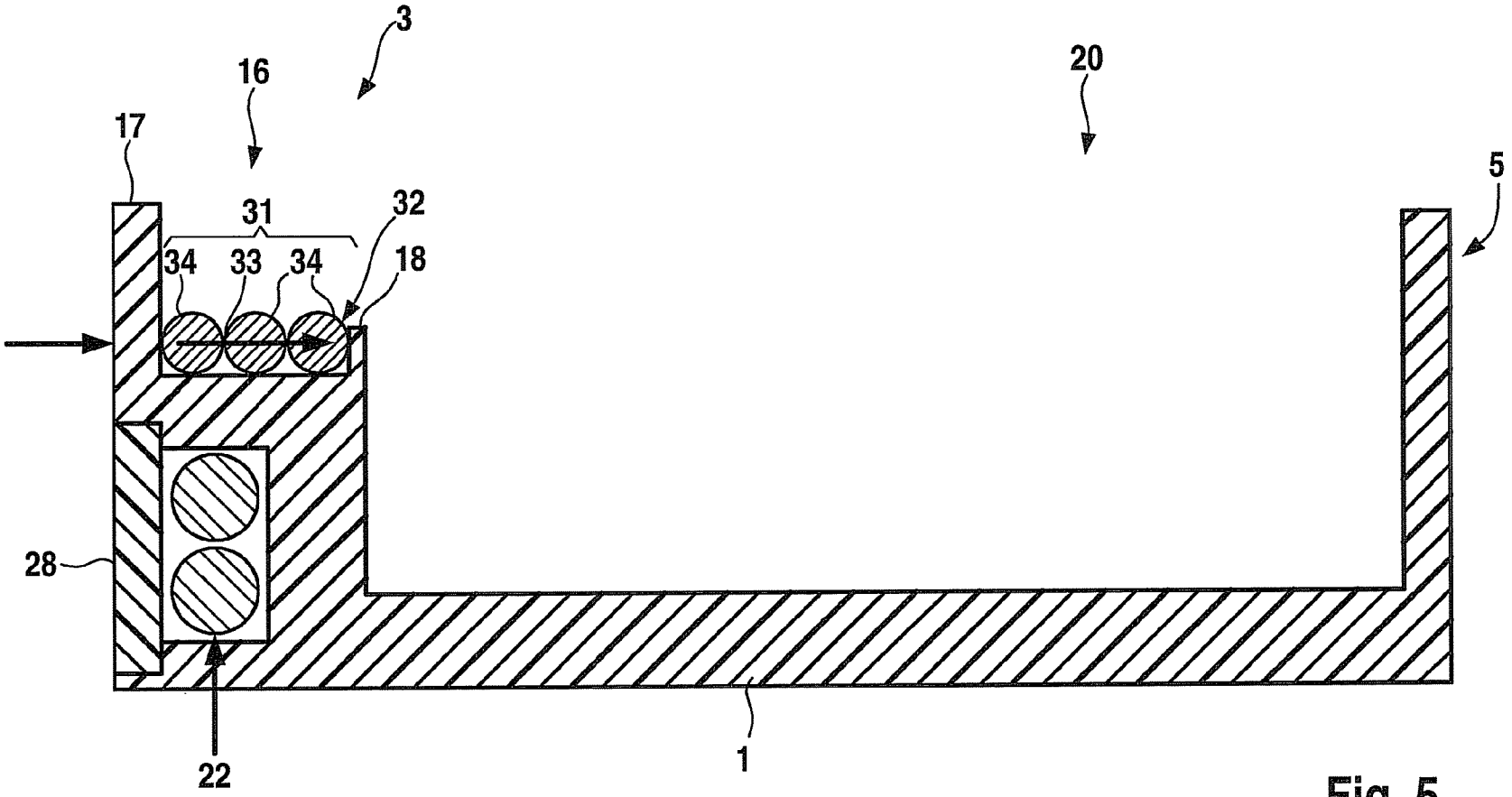
FIGS. 5 to 11 show the step-wise preparation of a holding winding on the coil brace.

FIGS. 5 to 11 show the positioning from FIG. 4 in the same sectional representation, it being shown step by step how the holding winding is prepared. FIG. 5 shows the first three turns 31 of holding winding 32, which are spooled or wound up in the direction of arrow 33, away from crosspiece 17. The overall width of the three turns 31 corresponds, in this instance, to the width of radial recess 16, the wire 34 being used having a smaller cross sectional area than wire 25 of pull-in winding 22.

Figure 6:
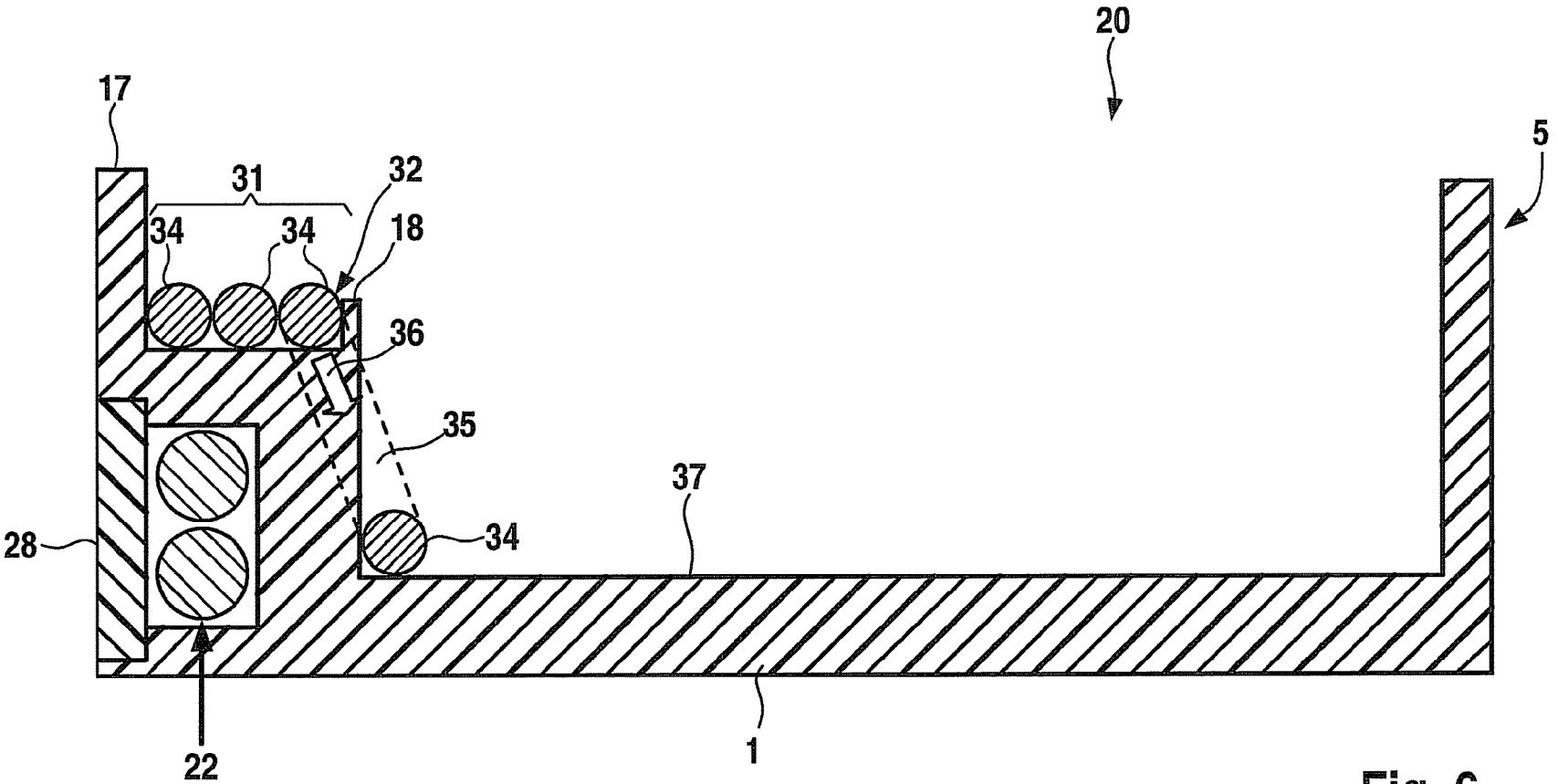

In the following step of the preparation of holding winding 32, shown in FIG. 6, wire 34 is guided via a ramp channel 35 in the direction of arrow 36 to an inner winding diameter 37 of chamber 20.

Figure 7:
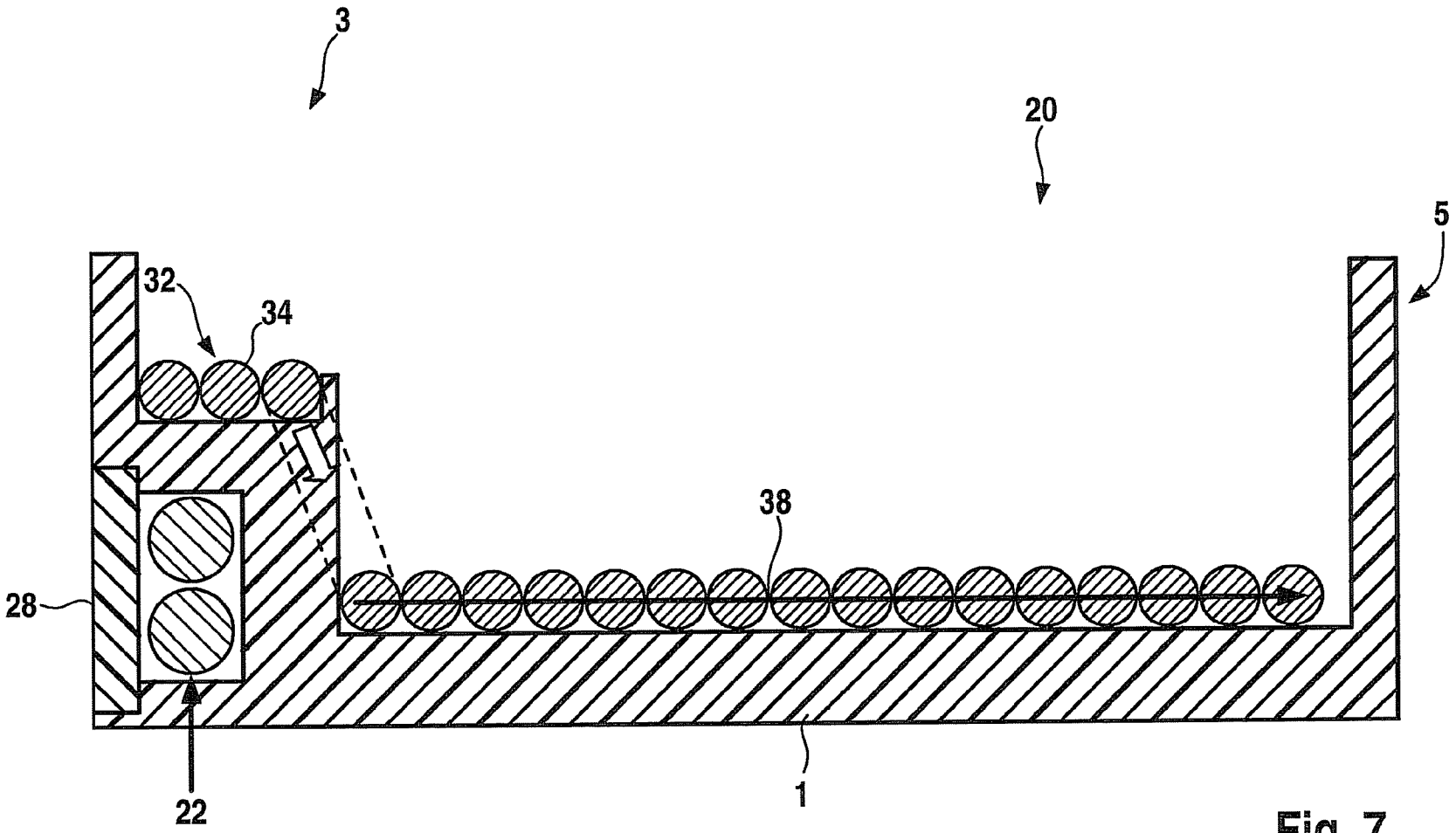

In FIG. 7 it is shown how, in the next step, a first layer of turns of the holding winding is spooled or wound along arrow 38 onto coil brace 1 up to delimitation 5, so that the first layer has, for example, a number of (e.g., 26) turns 31 on inner winding diameter 37, in the drawings only 16 turns being shown for the sake of clarity.

Figure 8:
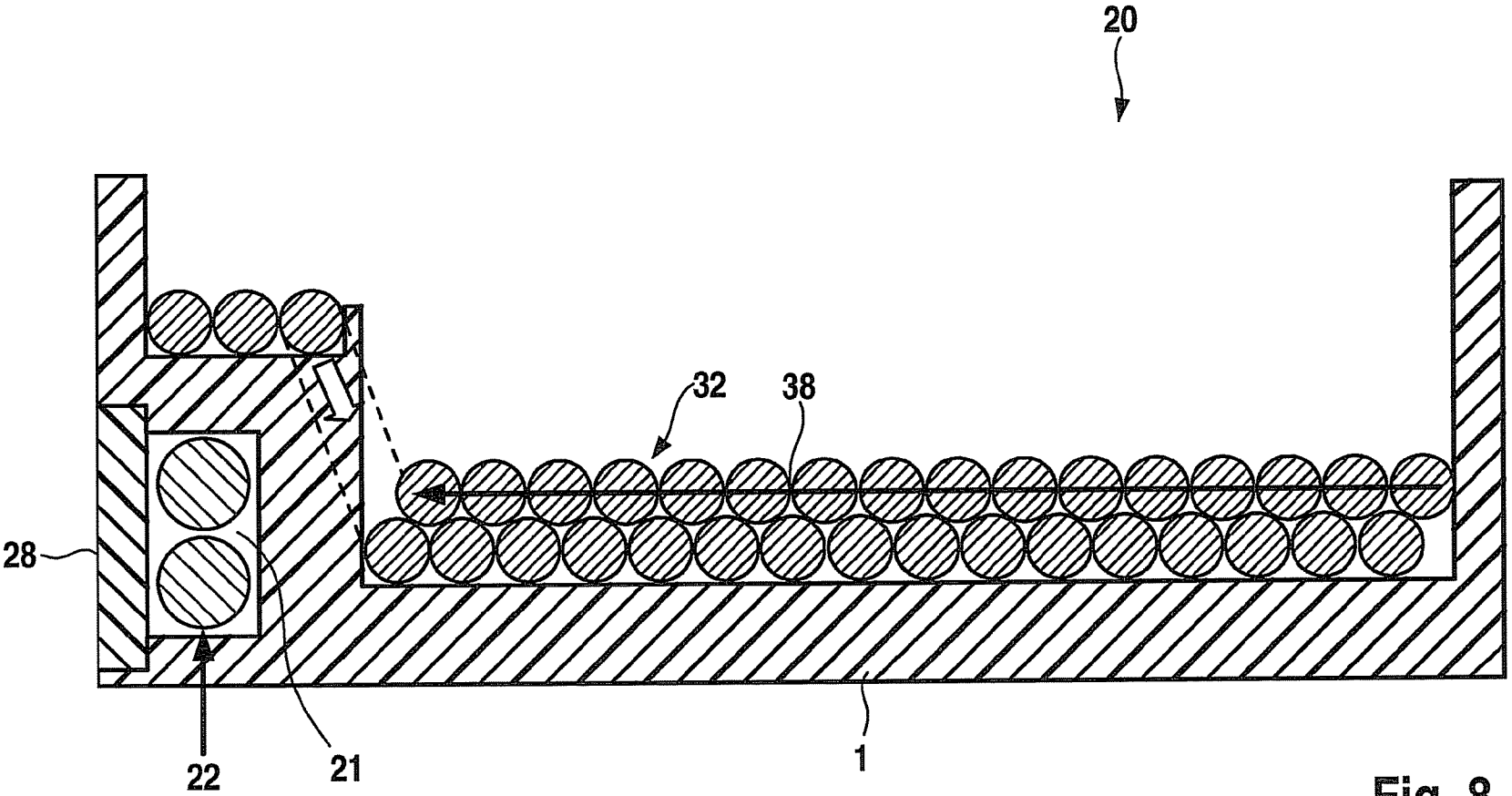

In the next step, shown in FIG. 8, a second layer of turns of holding winding 32 is wound in reverse along arrow 38' over the first layer, the two layers having the same number of turns.

Figure 9:
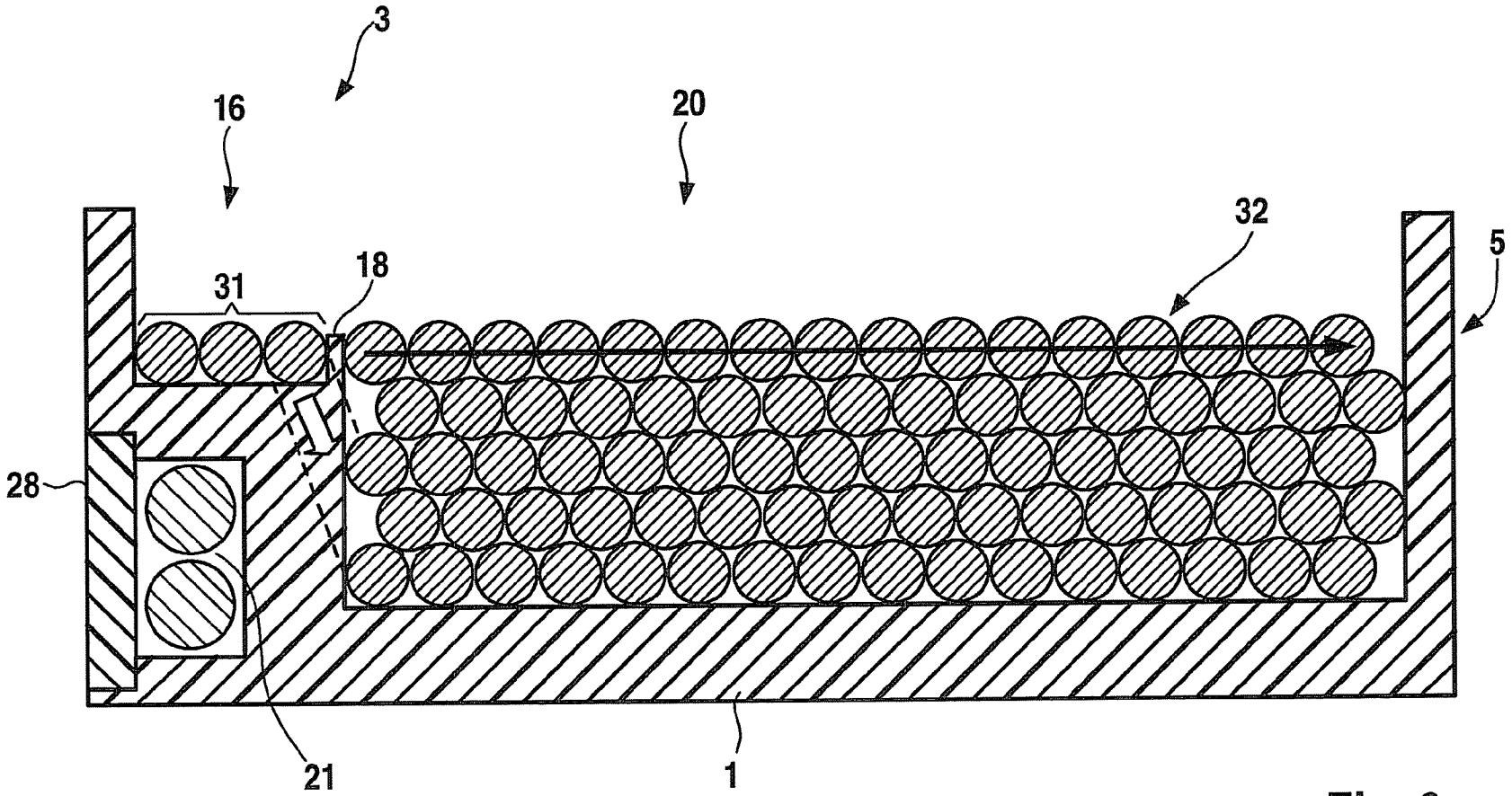

Subsequently, as shown in FIG. 9, three additional layers, having 26 turns each (only 16 are shown for sake of clarity), of holding winding 32 are prepared in the manner explained, the uppermost layer having the same winding diameter as the first 3 turns 31 in radial recess 16.

Figure 10:
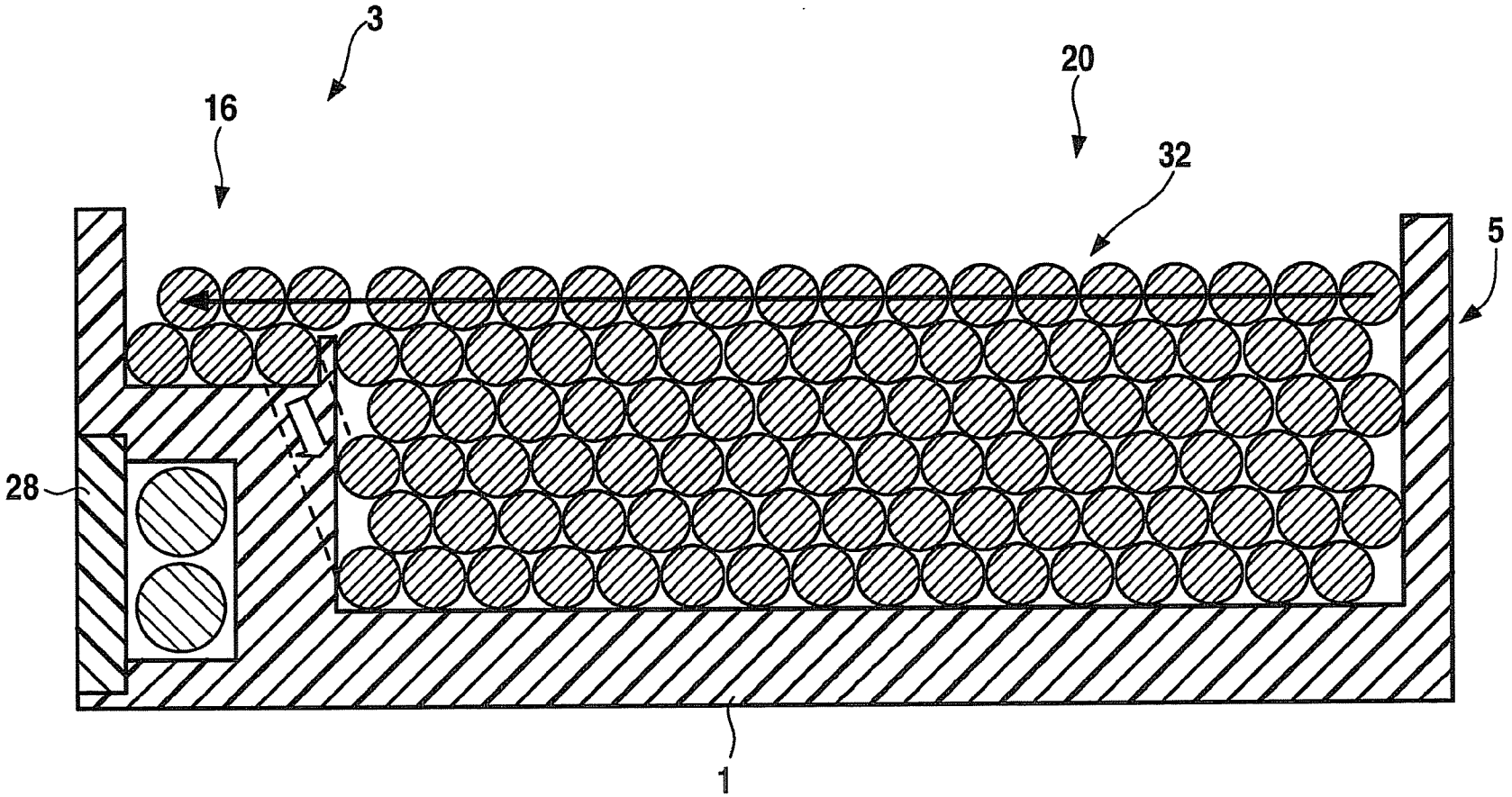
Figure 11:
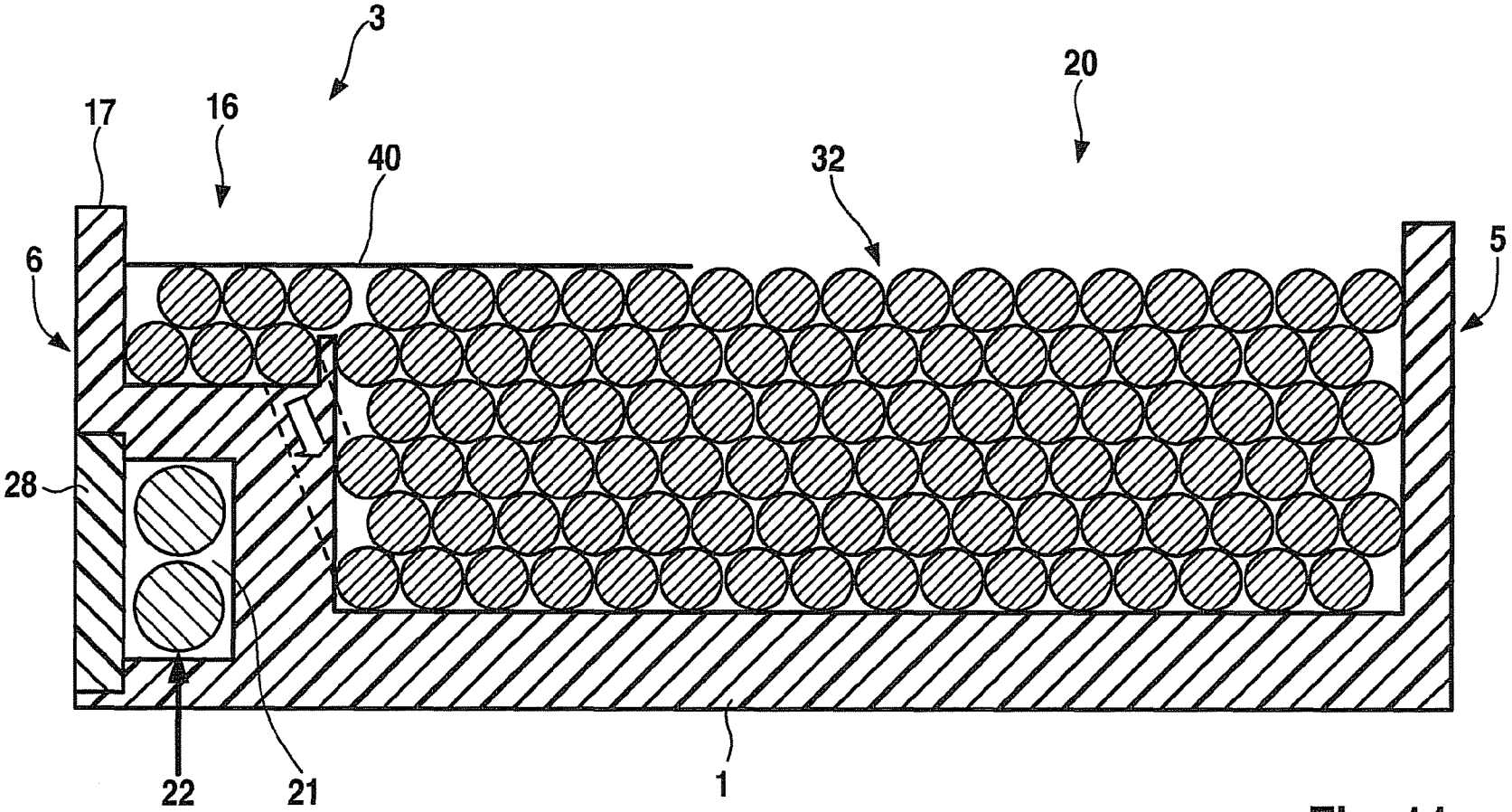

In FIG. 10, uppermost layer of turns is finally wound along right to left arrow on top of the five layers which have been spooled on the inner winding diameter and the first three turns 31 in radial recess 16, so that the uppermost layer is developed over the entire width of chamber 20, and has 29 turns (in FIG. 10, only 19 turns are shown for the sake of clarity). In order to fix holding winding 32 on coil brace 1, a fixing bandage 40 is wound above the uppermost layer of turns of holding winding 32, as shown in FIG. 11, the turns of the fixing band at least partially overlapping. As the fixing band, one may use a crepe adhesive band, for example.

Coil brace 1 may be made both of plastic, as shown in FIGS. 1, 2 and 4 to 11, and of metal.

Figure 12:
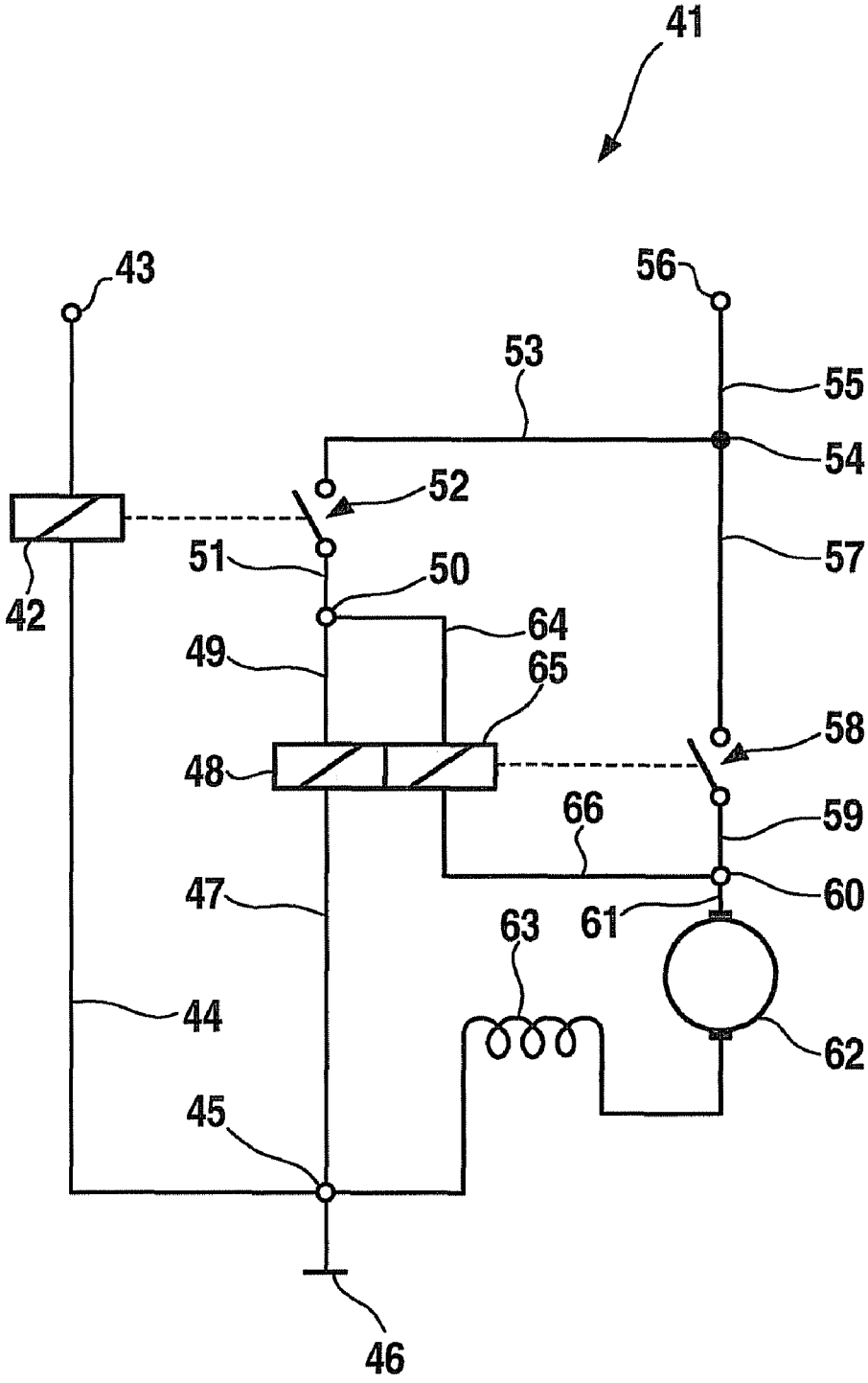
FIG. 12 shows a block diagram of the circuit of a device for shifting a drive element from the related art, according to a first example embodiment.

FIG. 12 shows a block diagram of a circuit 41 of a device for shifting a drive element, or rather a drive pinion, from the related art. What is shown is a control relay 42 which is connected to voltage source 43, and to node 45 via a line 44. A ground 46 is also connected to node 45, which is shown, for instance, as a housing connection. A line 47 leads from node 45 to a holding winding 48, from which a connection 49 leads to a node 50. A line 51 leads from a node 50 to a switch 52, which is operated by control relay 42. An additional line 53 leads from switch 52 to a node 54, from which a line 55 leads to a voltage source 56. An additional line 57 leads from node 54 to a switch 58, from which a line 59 leads to a node 60. From node 60 a line 61 leads to a motor 62, which is connected via a coil 63, using which, motor 62 is electromagnetically excitable, to node 45. A line 64 leads from node 50 to a pull-in winding 65, which is connected to node 60 via a line 66.

When switch 52 is closed by control relay 42, both holding winding 48 and pull-in winding 65 are excited electromagnetically. Pull-in winding 65 and holding winding 48, which are situated on one coil brace, set a core in motion, whereby the drive pinion is pushed onto a toothed wheel of a drive, for instance, of a drive device of a motor vehicle. At the same time, motor 62 is operated via the pull-in winding 65 using a slight torsional current, so that the drive pinion is additionally rotated during the push-in process, so that the probability that a tooth of the pinion hits a tooth of the toothed wheel is reduced.

Because of the movement of the core, switch 58 is also closed, whereby motor 62 is directly connected to voltage source 56, so that motor 62 starts up, for example, at full torque. When switch 52 is closed by control relay 42, a resupply of current is able to take place from pull-in winding 65 to holding winding 48. In order for the two magnetic fields of the coils mutually approximately to cancel out, they have to have nearly the same number of turns, so as to make possible switching off motor 62.

FIG. 13 shows the block diagram of FIG. 12, the difference being that, between pull-in winding 65 and node 50, a switch is provided in line 64. Switch 67 is situated, in this context, in such a way that it is also operated by the motion of the core. Because of that, a resupply of current of holding winding 48 via pull-in winding 65 is able to be prevented, and pull-in winding 65 and holding winding 48 do not have to have the same number of turns. This has the advantage that windings 48, 65 may in each case be designed optimally for their task.

Windings 48, 65 of FIGS. 13 and 12 are designed to be in the same direction, so that their magnetic fields supplement each other. FIG. 14 shows a diagram which shows schematically the magnetomotive force over time, time t being plotted along the abscissa and the magnetomotive force $\Theta$ along the ordinate. At a point $T_0$, both holding winding 48 and pull-in winding 65 are supplied with current, a magnetomotive force $\Theta_1$ of holding winding 48 being supplemented with a magnetomotive force of pull-in winding 65 to form a total magnetomotive force $\Theta_2$. At a later time $T_1$, the magnetic field of pull-in winding 65 breaks down because of the opening of switch 67, so that, up to the closing of switch 58 at time $T_2$ and ultimately also to the final opening of switch 52 at time $T_3$, only holding winding 48 remains supplied with current.

FIG. 15 shows schematically the circuit of FIG. 13, the difference being that holding winding 48 and pull-in winding 65 are developed in such a way that they act in the opposite direction. This is reflected in the diagram of FIG. 16, which shows the magnetomotive force of holding winding 48 and pull-in winding 65 over time. The diagram is constructed the same as the diagram of FIG. 14, so that time t is plotted along the abscissa and the magnetomotive force, or rather the strength of magnetic field $\Theta$ is plotted along the ordinate. From time $T_0$, at which switch 52 is closed, to time $T_1$, at which switch 67 is opened (by the motion of the core), the magnetic field of pull-in winding 65 acts against the magnetic field of holding winding 48, so that total magnetomotive force $\Theta_3$ turns out to be less than magnetomotive force $\Theta_1$ of holding winding 48. Because of the weakened magnetic field, the core moves more slowly, whereby the meshing process is prolonged by time $\Delta T$, and thereby time $T_1$ is shifted to later, as compared to the example in FIG. 13, whereby the drive pinion is rotated further. With the opening of switch 67 at time $T_1$, the magnetic field of pull-in winding 65 breaks down, so that now the non-weakened magnetic field of holding winding 48 acts on the core. By the closing of switch 58 at time $T_2$, the pinion pushed in by the core is driven by motor 62 that has now been switched on. By opening switch 52 at time $T_3$, holding winding 48 is deexcited, the core is shifted into its original position by an appropriate restoring spring, and thus switch 58 is opened again.

Figure 17:
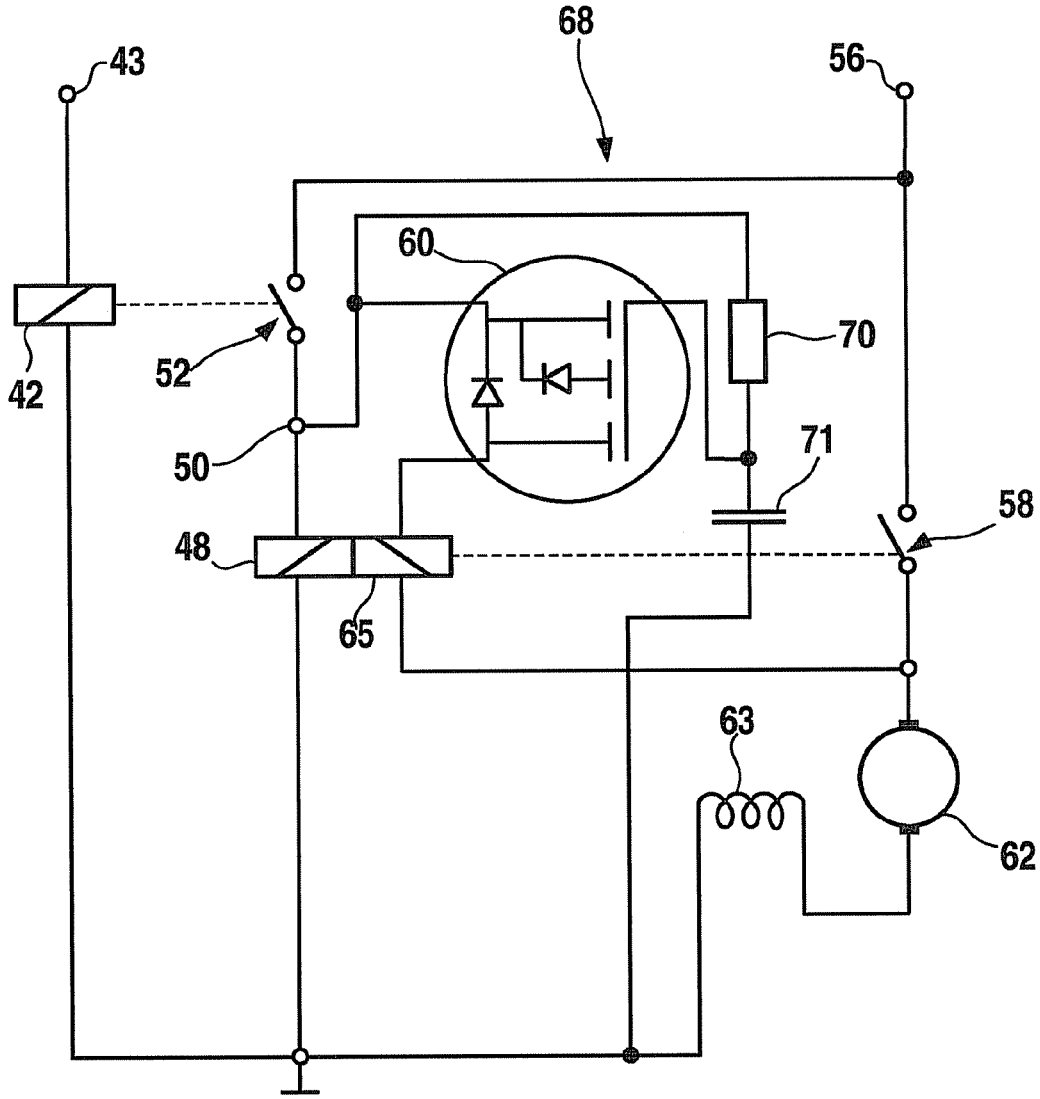
FIG. 17 shows a block diagram of the circuit from the related art according to a fourth exemplary embodiment.

FIG. 17 shows the circuit of FIG. 15 having the windings 48, 65 acting in opposite directions and the difference being that, instead of switch 67, an electronic switch 68 is provided which has an actual semiconductor switch 69, a resistor 70 and a capacitor 71. By closing switch 52, the series connection of resistor 70 and capacitor 71 is connected to the voltage source. Electronic semiconductor switch 69 is conductive and switches off only after a certain time, namely, when capacitor 71 is charged.

The following might also be conceivable as electronic switching elements: Bipolar transistors, various FET types, an IGBT (insulated gate bipolar transistor), an IGCT (integrated gate commutated thyristor), a GTO thyristor and/or an MCT (mos controlled thyristor).

The circuit according to FIG. 17 may, of course, also be used having a pull-in winding 65 and a holding winding 48 which act in the same direction. Block diagrams 13, 15 and 17 thus show a device which may be used, for instance, as a starter device for internal combustion engines. The configuration, made up of coil brace 1 according to the present invention, holding winding 48, pull-in winding 65 and the core that is movable thereby, in this context, assumes the position of the usual starter solenoid switch.

What is claimed is:

1. A coil system, comprising:

a holding winding;

a pull-in winding; and a tube-shaped coil brace having a first delimitation member at one end and a second delimitation member at an opposite end, wherein the holding winding is situated between the first and second delimitations, and wherein a side of the first delimitation facing away from the second delimitation has an axial recess configured to accommodate the pull-in winding.

2. The coil system as recited in claim 1, wherein the number of layers of turns of the pull-in winding is even.

3. The coil system as recited in claim 2, wherein the pull-in winding has two turns.

4. The coil system as recited in claim 2, wherein the turns of the pull-in winding lie in a common plane.

5. The coil system as recited in claim 4, further comprising:

an access panel situated at one end of the coil brace to fix the pull-in winding in the axial recess.

6. The coil system as recited in claim 5, wherein a radial recess is provided in the first delimitation member.

7. The coil system as recited in claim 6, wherein at least one part of the holding winding is situated in the radial recess.

8. The coil system as recited in claim 7, wherein the radial recess and the axial recess are configured in such a way that the pull-in winding and the holding winding are adjacent at least axially.

9. The coil system as recited in claim 7, wherein the pull-in winding is configured to act in the same direction as the holding winding.

10. The coil system as recited in claim 7, wherein the pull-in winding is configured to act in the opposite direction to the holding winding.

11. A device for shifting a drive element, comprising:

an electromagnetic drive having a coil system, wherein the coil system includes:

a holding winding;

a pull-in winding; and a tube-shaped coil brace having a first delimitation member at one end and a second delimitation member at an opposite end, wherein the holding winding is situated between the first and second delimitations, and wherein a side of the first delimitation facing away from the second delimitation has an axial recess configured to accommodate the pull-in winding;

a movable core configured to be excited and moved by the coil system;

a first switch and a second switch configured to be selectively opened and closed, wherein opening of the first switch first interrupts a current flow through the pull-in winding and subsequently enables closing of the second switch, and wherein the closing of the second switch makes possible a current supply of a main drive for the drive element.

12. The device as recited in claim 11, wherein the first switch is one of a mechanical switch or an electronic switch.

* * * * *